United States Patent [19]

Huber et al.

[11] Patent Number: 4,676,082

[45] Date of Patent: Jun. 30, 1987

[54] CENTRAL LOCKING SYSTEM FOR A MOTOR VEHICLE

[75] Inventors: G. Huber, Aidlingen; Rudi Kneib, Sindelfingen, both of Fed. Rep. of Germany

[73] Assignee: Daimler-Benz Aktiengesellschaft, Fed. Rep. of Germany

[21] Appl. No.: 728,031

[22] Filed: Apr. 29, 1985

[30] Foreign Application Priority Data

Apr. 28, 1984 [DE] Fed. Rep. of Germany ..... 3415996

[51] Int. Cl.[4] ..... E05B 65/36

[52] U.S. Cl. ..... 70/264; 70/241

[58] Field of Search ..... 70/264, 263, 262, 277, 70/279, 280, 281, 282, 240, 241, 237

[56] References Cited

U.S. PATENT DOCUMENTS

| | | | |
|---|---|---|---|
| 3,200,623 | 8/1965 | Peters . | |
| 4,322,959 | 4/1982 | Mochida | 70/264 |
| 4,537,049 | 8/1985 | Lupoli | 70/264 |

FOREIGN PATENT DOCUMENTS

| | | |
|---|---|---|
| 1202680 | 10/1965 | Fed. Rep. of Germany . |
| 3313092 | 10/1984 | Fed. Rep. of Germany . |

*Primary Examiner*—Robert L. Wolfe

*Attorney, Agent, or Firm*—Barnes & Thornburg

[57] ABSTRACT

A central locking system in a motor vehicle, by means of which an automatic locking of at least the rear lid is effected in every case when the vehicle is driven with non-desired locking of the doors.

13 Claims, 4 Drawing Figures

CENTRAL LOCKING SYSTEM FOR A MOTOR VEHICLE

The present invention relates to a central locking installation for a motor vehicle for locking mechanisms of at least the front doors and at least the rear lid of a motor vehicle, which are actuatable together at least centrally from the driver door by way of control lines and in which for the separate actuation, independent of the overall actuation, of at least the locking mechanism of the rear lid, an actuating member coordinated thereto is provided.

A central locking system of the aforementioned type is disclosed in the DE PS No. 11 28 323, in which one actuating element each is coordinated to each locking mechanism—i.e. for example, also to the locking mechanism of the rear (trunk) lid—for their separate actuation and at least one central actuating element, for example, the door lock, is coordinated to all locking mechanisms for the common locking and unlocking thereof. During actuation of one or several of the actuating members, for example, of the handle of the door or of the rear lid, only the respectively coordinated locking mechanisms are closed by way of the pressure medium circulation respectively are opened with opposite actuation whereas with an actuation of the initiating element, the central locking of all locking mechanisms, which is functionally of higher rank, is effected thereby. In contrast to those prior art pressure-medium-actuated central locking systems, in which the vehicle can be only completely locked or unlocked, the aforementioned prior art installation therefore permits an independent actuation of a single locking mechanism as well as a complete central locking.

Starting therefrom the object of the present invention resides in so further developing a central locking system of the aforementioned type that with a non-desired complete central locking, at least the rear lid is always securely locked in a simple manner during a driving operation without separate key actuation and assuring always the function of the locking thereof.

The underlying problems are solved according to the present invention in that the actuating member is the ignition lock switch which in the effected on-position with a non-engaged central locking is operable, on the one hand, to control a switching member which switches only the control line leading to the locking mechanism of at least the rear lid and, on the other, causes the locking of at least the rear lid to be automatically activated by way of the switched control line.

With such a central locking system in particular the needs of those persons are taken into consideration, for whom it is psychologically not acceptable during driving operation to be seated in a centrally locked vehicle but who at the same time wish to have the security that at least the rear lid of their vehicle is locked and thus no possibility exists for an unauthorized access into the luggage space. It is thereby essential that with a non-actuated central locking system in the driving operation which can be activated in a known manner by actuation of the interior door lock knob, the locking mechanism of the rear lid is always effected automatically from the vehicle interior space. The installation is thereby so constructed that both the function and the heretofore known actuation of the central locking system remains substantially preserved as also a locking of the doors is still possible when the rear lid is already locked.

These and other objects, features and advantages of the present invention will become more apparent from the following description when taken in connection with the accompanying drawing which shows, for purposes of illustration only, two embodiments in accordance with the present invention, and wherein.

Figure 3:
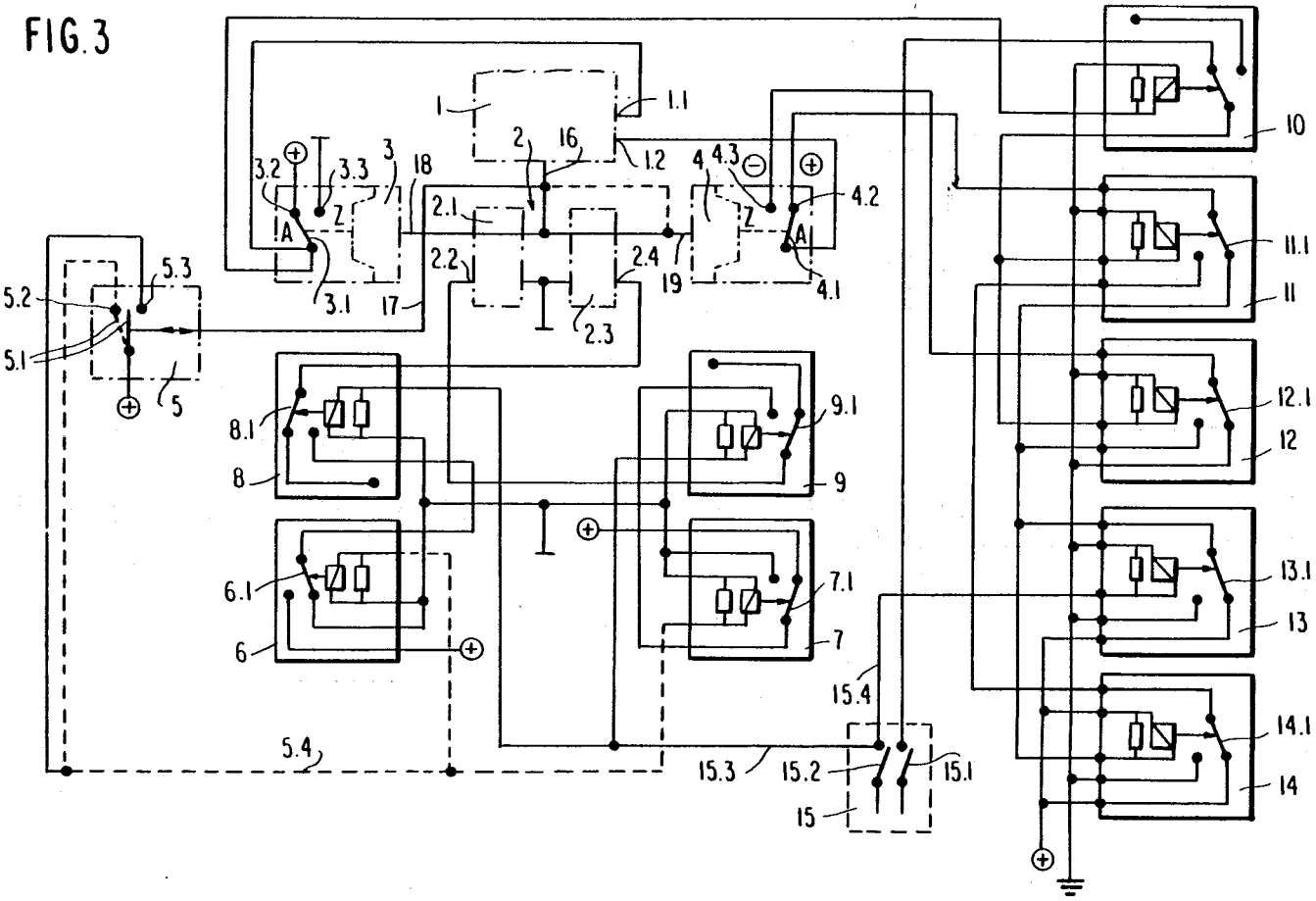
Figure 4:
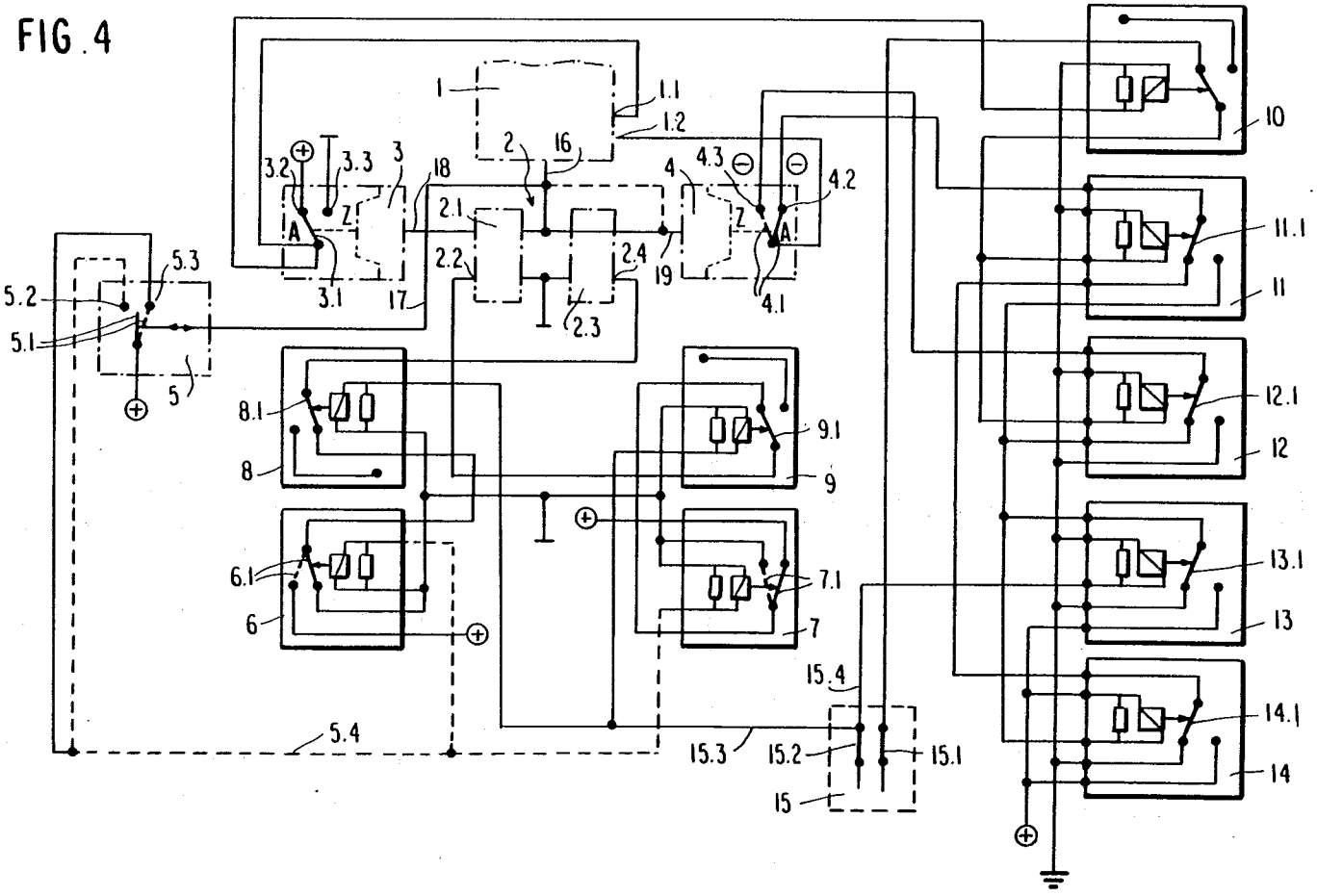

FIG. 3 is a schematic diagram of a second embodiment of a central locking installation in accordance with the present invention in the normal rest condition, in which all locking mechanisms and the ignition lock switch are opened; and FIG. 4 is a schematic diagram of the central locking installation according to FIG. 3 with an engaged locking mechanism of only the rear lid after the closing of the ignition lock switch.

Referring now to the drawings wherein like reference numerals are used throughout the various views to designate like parts, the central locking system illustrated in the various figures essentially consists of the following components: of a bipressure pump 1 actuating the locking elements, of a shifting member generally designated by reference numeral 2 consisting of the electromagnetic valves 2.1 and 2.3, of the locking element 3 on the side of the driver door, of the locking element 4 at the rear lid, of a push-button or momentary switch 5, of two switching relays 6 and 7, of seven working relays 8 to 14, of the ignition lock switch 15 and of the control lines 16 to 19 starting from the bipressure pump 1.

Figure 1:
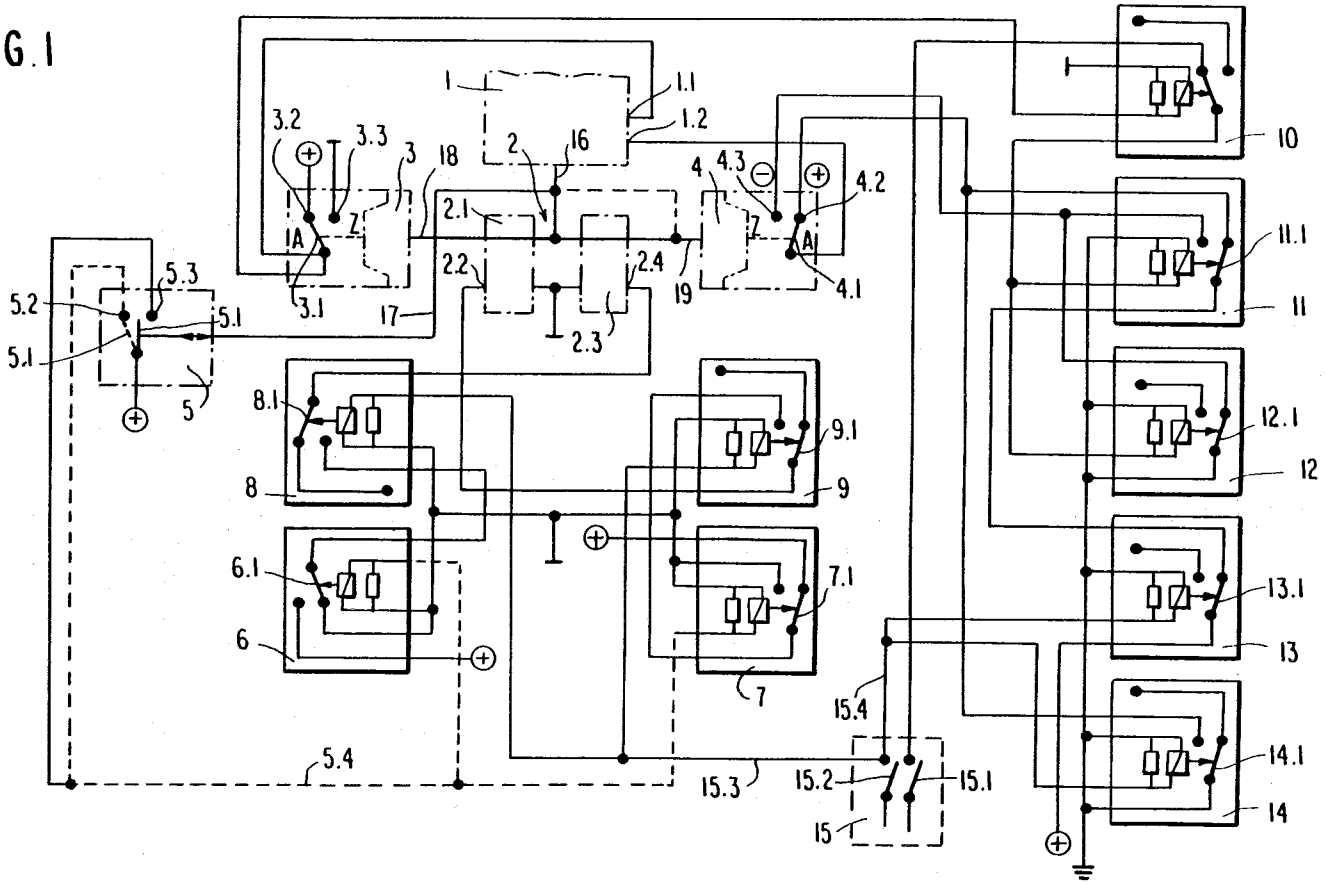
FIG. 1 is a schematic diagram of a central locking installation in accordance with the present invention in the normal rest condition, in which all locking mechanisms and the ignition lock switch are opened.

In the schematic diagram according to FIG. 1 in which all locking mechanisms are unlocked and the switching contacts 15.1 and 15.2 of the ignition lock switch 15 are open, the switch contact 5.1 of the push-button switch 5 was actuated for a short period of time by the bipressure pump 1 during unlocking of the installation by way of the control lines 16 and 17 so that, on the one hand, the switching relay 6 was activated by way of the contact 5.2 and the pulse line 5.4 and the switching contact 6.1 thereof was connected to negative potential (as shown) and, on the other hand, the switching relay 7 was activated and the switching contact 7.1 thereof was connected to the positive potential. The operating relays 8 and 9 are in the illustrated normal (de-energized) position due to the open ignition lock switch 15 so that, on the one hand, the input 2.4 of the electromagnetic valve 2.3 is without potential by way of the switching contact 8.1 and on the other, the input 2.2 of the electromagnetic valve 2.1 is without potential by way of the switching contact 9.1, i.e. the electromagnetic valves 2.1 and 2.3 are not activated and are thus in their OPEN-position. While additionally the working relays 11, 12, 13 and 14 are also in the normal de-energized position, the working relay 10 is in the operating (energized) position because it is activated (energized) by way of the switching contact 3.1 of the switching device of the locking element 3 which is at plus-potential by way of the OPEN-contact 3.2 (A). Furthermore, positive potential is present at the input 1.1 of the bipressure pump 1 connected with the locking element 3 on the side of the driver door and positive potential is also present at the input 1.2 of the bipressure pump 1 connected with the locking element 4 of the rear lid because the OPENcontact 4.2 (A) of the switching device of the rear lid locking element 4 is connected to the plus potential by way of the deenergized working relays 11 and 13, as shown. In contrast thereto the CLOSED-contact 4.3 (Z) of the switching device of the rear lid locking element 4 is at minus potential by way of the deenergized working relay 12.

Figure 2:
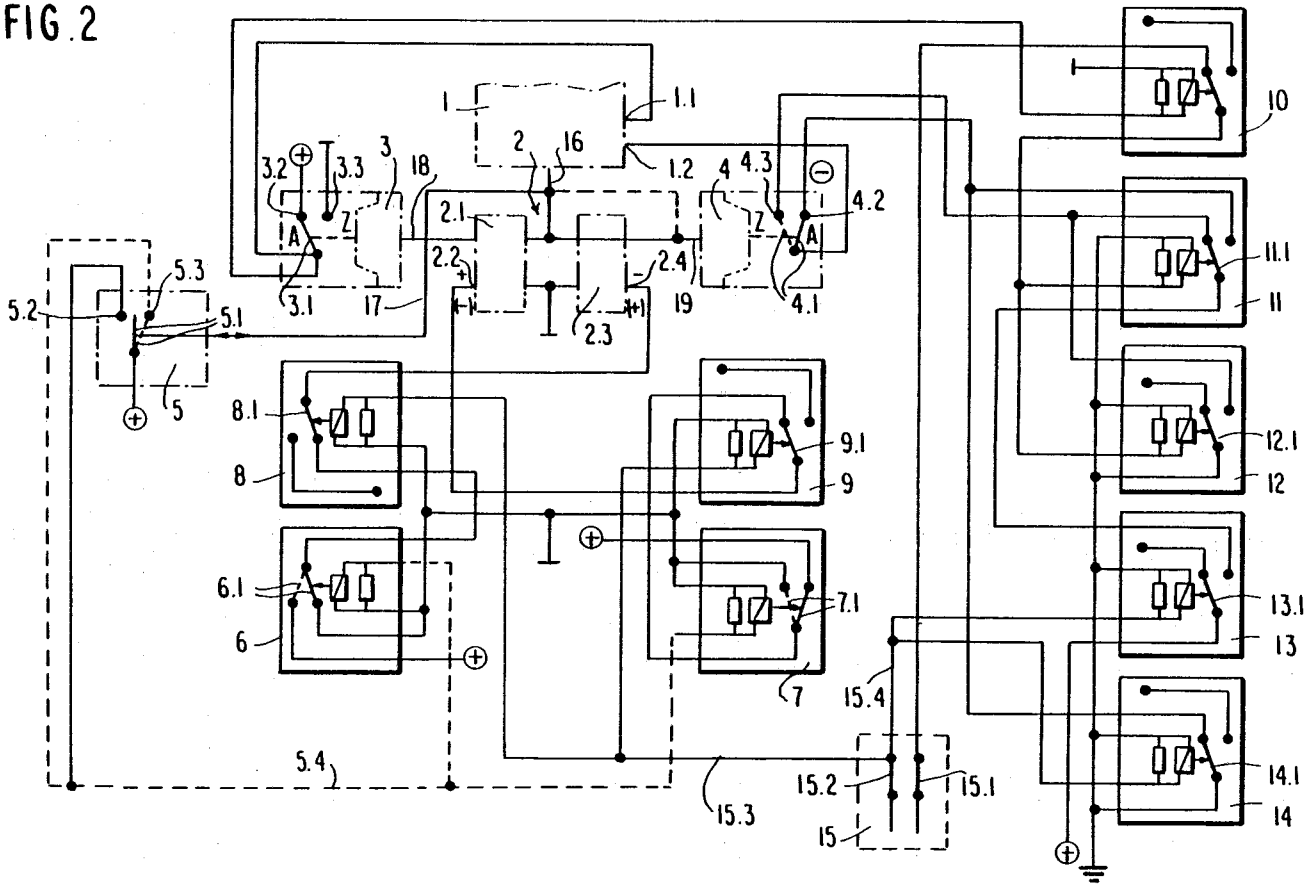
FIG. 2 is a schematic diagram of the central locking installation according to FIG. 1 with an engaged locking mechanism of only the rear lid after the closing of the ignition lock switch.

If the wish now exists not to centrally lock the vehicle during the drive—the central locking system can be effected for example by actuation of the interior door locking knob at the driver door and thus by switching the switching contact 3.1 from the OPEN-contact 3.2 (A) to the CLOSED-contact 3.3 (Z) connected to minus potential, as a result of which minus potential also reaches the input 1.1 of the bipressure pump 1 and the latter is activated—according to the present invention with the start of the vehicle at least the rear lid is automatically locked and more particularly in dependence on the actuation of the ignition lock switch 15 (see FIG. 2). If the ignition lock switch 15 is brought into the position "1" by means of the vehicle key, then the switching contact 15.1—which is connected, for example, with the terminal (15) of the electric system of the vehicle—is closed and the working relays 11 and 12 are activated by way of the working relay 10 so that the switching contacts 11.1 and 12.1 thereof pass over into the operating (energized) position. As a result thereof, at first the OPEN-contact 4.2 (A) of the locking element 4 at the rear lid becomes without potential and the CLOSED-contact 4.3 (Z) is switched to plus potential by way of the now energized working relay 11 and the still deenergized working relay 13. If by further rotation of the vehicle key the ignition lock switch 15 is brought into its position "2" then also the switching contact 15.2—which is connected with the terminal (12) of the electric system of the vehicle—is closed. On the one hand, the working relays 8 and 9 are activated (energized) thereby by way of the switching line 15.3 and the switching contacts 8.1 and 9.1 pass over into the operating (energized) position; minus potential thereby reaches the input 2.4 of the electromagnetic valve 2.3 by way of the switching contact 8.1 and the switching contact 6.1 of the switching relay 6 so that the electromagentic valve 2.3 continues to remain in its OPEN-position whereas plus potential reaches the input 2.2 of the electromagnetic valve 2.1 by way of the switching contact 7.1 of the switching relay 7 and the switching contact 9.1 so that the electromagnetic valve 2.1 passes over into its CLOSED-position and interrupts the control line 18. On the other hand, the operating relays 13 and 14 are activated (energized) by way of the switching line 15.4 and the switching contacts 13.1 and 14.1 thereof pass over into the operating (energized) position. The switching contact 13.1 thereby renders the CLOSED-contact 4.3 (Z) of the locking element 4 without potential by opening the circuit whereas minus potential reaches the OPEN-contact 4.2 (A) by way of the switching contact 14.1 and therefore also the input 1.2 of the bipressure pump 1 by way of the switching contact 4.1. Thus, by reason of the fact that the input 1.1 was changed from plus to minus potential the bipressure pump 1 starts to operate by reason of the switching pulse and activates, on the one hand, by way of the control line 16 the electromagnetic valve 2.3 and on the other, by way of the control line 19 the locking mechanism of the rear lid. The rear lid is now locked whereas during the locking operation the switching contact 4.1 was switched to the CLOSED-contact 4.3 (Z) which is without potential owing to the open circuit in energized relay 13. Since the control line 18 is interrupted by the electromagnetic valve 2.2, the locking mechanism 3 of the driver door can therefore not be activated, it therefore remains unlocked as desired. On the other hand, also the switch contact 5.1 of the push-button switch 5 was switched for a short period of time to the contact 5.3 thereof by the bipressure pump 1 by way of the control lines 16 and 17, as a result of which plus potential reached by way of the push-button contact 5.1, the contact 5.3 and the pulse line 5.4 on the one hand, the switching relay 6 and the latter switched the switching contact 6.1 to plus potential and, on the other, the switching relay 7 and the latter switched the switching contact 7.1 to minus potential. By switching the switching contact 6.1 to plus potential, plus potential also reaches the input 2.4 of the electromagnetic valve 2.3 which then passes over into its CLOSED-position and by switching the switching contact 7.1 to minus potential, minus potential also reaches the input 2.2 of the electromagnetic valve 2.1 which then passes over into its OPEN-position. This switching of the electromagnetic valves has thereby no influence any longer on the effected locking because at the instant of the switching, the locking operation responding to switching pulses is already terminated. The switching has solely the purpose to determine corresponding starting-switch positions so that either by actuation of the interior door lock knob an additional locking of the door is also still possible or after termination of the drive the normal deenergized condition position of the installation according to FIG. 1 is automatically re-established by opening of the switching contacts 15.1 and 15.2 of the ignition lock switch 15.

Whereas with the bipressure pump used in FIGS. 1 and 2, by reason of the internal circuit logic, the produced switching pulse at the OPEN-contact 4.2 (A) of the locking element 4 at the rear lid and thus also at the input 1.2 of the bipressure pump 1 suffices during changing from plus to minus potential in order to activate the bipressure pump for a full operating cycle, a circuit arrangement is shown in FIGS. 3 and 4 in which a bipressure pump can be used with another internal circuit logic, and more particularly such a bipressure pump which requires minus potential at the input 1.2 not only by way of the OPEN-contact 4.2 (A) of the locking element 4 but continues to require minus potential also after the switching of the switching contact 4.1 to the CLOSED-contact 4.3 (Z) by way of the same in order to make it possible for the pump that it can also complete the operating cycle initiated by the changing from plus to minus potential at the OPEN-contact 4.2.

As in the schematic diagram according to FIG. 1, in the schematic diagram according to FIG. 3, in which also all locking mechanisms are unlocked and the switching contacts 15.1 and 15.2 of the ignition lock switch are open, the switch contact 5.1 of the push-button switch 5 was actuated for a short period of time by the bipressure pump 1 during the unlocking of the installation by way of the control lines 16 and 17 so that, on the one hand, the switching relay 6 is activated (energized) by way of the contact 5.2 and the pulse line 5.4 and the switching contact 6.1 thereof is connected to minus potential and, on the other, the switching relay 7 is activated (energized) and the switching contact 7.1 thereof is connected to plus potential. The working relays 8 and 9 are in the illustrated normal deenergized position so that, on the one hand, the input 2.4 of the electromagnetic valve 2.3 is without potential by way of the switching contact 8.1 and on the other hand, the input 2.2 of the electromagnetic valve 2.1 is without potential by way of the switching contact 9.1, i.e. the electromagnetic valves 2.3 and 2.1 are not activated and are thus in their OPEN-position. Whereas also the working relays 11, 12, 13 and 14 are in the normal deenergized position, the working relay 10 is in the operating (energized) position because it is activated (energized) by way of the switching contact 3.1 of the switching device of the locking element 3 which is connected to plus potential at the OPEN-contact 3.2 (A). Furthermore, plus potential is present at the input 1.1 of the bipressure pump 1 connected with the locking element 3 on the side of the driver door and also at the input 1.2 of the bipressure pump 1 connected with the locking element 4 of the rear lid because the OPEN-contact 4.2 (A) of the switching device of the locking element 4 is connected to plus potential by way of the deenergized operating relays 11 and 13. In contrast thereto, the CLOSED-contact 4.3 (Z) of the switching device of the rear lid locking element 4 is connected to minus potential by way of the deenergized working relay 12.

If now the wish exists not to centrally lock the vehicle during the drive, then according to the present invention when starting the vehicle, at least the rear lid is automatically locked and more particularly in dependence on the actuation of the ignition lock switch 15, see FIG. 4. If the ignition lock switch 15 is brought into the position "1" by means of the vehicle key, then the switching contact 15.1—which is connected, for example, with the terminal (15) of the electrical system of the vehicle—is closed and the working relays 11 and 12 are activated (energized) by way of the energized working relay 10 so that the switching contacts 11.1 and 12.1 pass over into the operating (energized) position. As a result thereof, at first the CLOSED-contact 4.3 (Z) of the locking element 4 at the rear lid is switched to plus potential. If during further rotation of the vehicle key the ignition lock switch 15 is brought into its position "2", then also the switching contact 15.2—which is connected to the terminal (30) of the electric system of the vehicle—is closed. On the one hand, the working relays 8 and 9 are activated (energized) thereby by way of the switching line 15.3 and the switching contacts 8.9 and 9.1 thereof pass over into the operating (energized) position; minus potential thereby reaches the input 2.4 of the electromagnetic valve 2.3 by way of the switching contact 8.1 and the switching contact 6.1 of the switching relay 6 so that the electromagnetic valve 2.3 continues to remain in its OPEN-position whereas positive potential reaches the input 2.2 of the electromagnetic valve 2.1 by way of the switching contact 7.1 of the switching relay 7 and the switching contact 9.1 so that the electromagnetic valve 2.1 passes over into its CLOSED-position and interrupts the control line 18. On the other hand, the working relay 13 is activated (energized) by way of this switching line 15.4 and as a result thereof the working relay 14 is activated (energized) and the switching contacts 13.1 and 14.1 thereof pass over into the operating (energized) position. The switching contact 13.1 thereby now switches the CLOSED-contact 4.3 (Z) of the locking element 4 to minus potential whereas minus potential also reaches the OPEN-contact 4.2 (A) by way of the switching contact 14.1 and also the input 1.2 of the bipressure pump 1 by way of the switching contact 4.1. Thus, by reason of the fact that the input 1.2 was changed from plus to minus potential, the bipressure pump 1 starts by reason of this switching pulse and activates, on the one hand, by way of the control line 16 the electromagnetic valve 2.3 and by way of the control line 19 the locking mechanism of the rear lid. The rear lid is now locked whereby during the locking operation the switching contact 4.1 was switched to the CLOSED-contact 4.3 (Z) connected to minus potential. Since the control line 18 is interrupted by the electromagnetic valve 2.1, the locking mechanism 3 of the driver door can therefore not be activated, it thus remains unlocked as desired. On the other hand, the switch contact 5.1 of the push-button switch 5 was switched for a short period of time by the bipressure pump 1 to the contact 5.3 thereof by way of the control lines 16 and 17, as a result of which plus potential reached, on the one hand, the switching relay 6 by way of the switch contact 5.1, the contact 5.3 and the pulse line 5.4 and the switching relay 6 switched the switching contact 6.1 to plus potential and on the other, plus potential also reached the switching relay 7 and the latter switched the switching contact 7.1 to minus potential. As a result of the switching of the switching contact 6.1 to positive potential, positive potential also reaches the input 2.4 of the electromagnetic valve 2.3 which then passes over into its CLOSED-position, and as a result of the switching of the switching contact 7.1 to minus potential, minus potential also reaches the input 2.2 of the electromagnetic valve 2.1 which then passes over into its OPEN-position. The switching of the electromagnetic valves also no longer has any influence in this embodiment on the effected locking because at the instant of the switching the locking operation responding to switching pulses has already been completed. Also in this case the switching has solely the purpose to determine corresponding starting switch positions so that either by actuation of the interior door lock knob also an additional locking of the door is still possible or after termination of the drive the normal condition-position of the installation according to FIG. 3 is automatically re-established by opening of the switching contacts 15.1 and 15.2.

Thus, going beyond the normal central locking function the further function can be fulfilled with the described central locking system in accordance with the present invention that a rear lid locking is effected automatically by way of the ignition lock switch if no central locking of the door is to be desired during driving operation.

Even though in the described embodiments only the automatic locking of the rear lid is illustrated and described, in case of need an enlargement of this automatic securing to the rear doors, the tank flap etc. is possible in a simple manner in that also the locking mechanisms thereof are connected to the control line 19. Equally an inclusion of the co-driver door is possible by way of the control line 18.

Furthermore, the control line 17 leading to the push-button switch 5 is branched off in the illustrated embodiments from the control line 16. However, depending on operating requirements of the central locking system for the passenger space, the control line 17 can also be branched off from the control line 19 between the electromagnetic valve 2.3 and the locking element 4.

Furthermore, a central locking system is illustrated in the embodiments in which the locking elements are controlled pneumatically or hydraulically. However, the present invention is applicable in an analogous manner also to central locking systems with electromagnetically controlled locking elements. For that purpose the pneumatic or hydraulic components only have to be replaced by corresponding electric and electromagnetic components.

While we have shown and described only two embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A central locking installation for locking vehicle doors including at least front doors and for locking at least a rear lid of a motor vehicle and having an ignition locking switch, comprising:

a first and second locking mechanism for locking and unlocking said vehicle doors and said lid respectively, central locking means for activating together the first and second locking mechanisms by way of a control line means, rear lid actuating means including said ignition locking switch for activation of at least the locking mechanism of the rear lid separately from activation of the locking means of said vehicle doors, switching means for the control line means, means for controlling one of said switching means to switch only the control line means leading to the second locking mechanism to automatically activate the second locking mechanism at least of the rear lid by the switched control line means when the ignition lock switch is in an activated position with said central locking means in a non-activated position.

2. A central locking installation according to claim 1, wherein said one switching means includes two electromagnetic valves.

3. A central locking installation according to claim 1, wherein said one switching means is constructed as one of electropneumatic and electrohydraulic multipath valve.

4. A central locking system according to claim 1, wherein when the ignition lock switch is in activated position, the controlled switching means interrupts the control line means leading to the locking mechanism on the side of a driver door for a length of time until the locking of the rear lid is effected.

5. A central locking installation according to claim 1, for a pneumatic or hydraulic single or multiposition installation, further comprising push-button switch means wherein at least one of said push-button switch means and said one switching means is integrated into a pump means.

6. A central locking installation according to claim 1, further comprising operating relay means provided in the installation activated, by way of which, on the one hand, the one switching means is controlled and on the other, a bipressure pump means is controlled when the ignition lock switch is in an activated position.

7. A central locking installation according to claim 6, wherein a push-button switch means is acted upon by said bipressure pump means upon activation thereof, which in turn activates switching relay means, by way of which the one switching means is controlled.

8. A central locking installation according to claim 1, wherein the locking mechanism for the rear lid includes a locking element, and wherein different voltage potentials are applied to the input of a bipressure pump means by way of a switching contact of the locking element of the rear lid.

9. A central locking installation according to claim 8, wherein the switching contact is operable to be connected with contacts of said locking element, to which different voltage potentials are applied by way of operating relay means provided in the installation.

10. A central locking installation according to claim 7, further comprising electromagnetic valve means operatively connected with the bipressure pump means by some of said control line means, and wherein the push-button switch means is acted upon by way of a control line means branched off from the control line means leading from the bipressure pump means to the electromagnetic valve means.

11. A central locking installation according to claim 7, further comprising electromagnetic valve means operatively connected with the bipressure pump means by some of said control line means, wherein the locking mechanism of the rear lid includes a locking element, and wherein the push-button switch means is acted upon by way of a control line means which is branched off from the control line means operatively connecting the electromagnetic valve means and the locking element.

12. A central locking system for motor vehicles having an ignition lock switch means, comprising:

a plurality of locking mechanisms for locking and unlocking various parts of the motor vehicle including vehicle doors and trunk lid, central locking means for locking in unison all the locking mechanisms from a central point, further means for separately activating the locking mechanism of at least one vehicle part other than the vehicle doors with the central locking means being non-activated, and control means including said ignition lock switch means for automatically activating said further means when said ignition lock switch means is in a position for driving the vehicle with the central locking means non-activated to thereby lock said at least one part while the doors remain unlocked.

13. A central locking system according to claim 12, wherein said at least one part is the trunk lid.

* * * * *